US011154747B2

(12) United States Patent
Frost

(10) Patent No.: US 11,154,747 B2
(45) Date of Patent: Oct. 26, 2021

(54) STATIONARY EXERCISE MACHINE

(71) Applicant: VIBRO SYSTEMS (PTY) LTD, Port Elizabeth (ZA)

(72) Inventor: Cecil Neil Frost, Port Elizabeth (ZA)

(73) Assignee: VIBRO SYSTEMS (PTY) LTD, Port Elizabeth (ZA)

( * ) Notice: Subject to any disclaimer, the term of this patent is extended or adjusted under 35 U.S.C. 154(b) by 0 days.

(21) Appl. No.: 16/487,529

(22) PCT Filed: Feb. 22, 2018

(86) PCT No.: PCT/ZA2018/050011
§ 371 (c)(1),
(2) Date: Aug. 21, 2019

(87) PCT Pub. No.: WO2018/157181
PCT Pub. Date: Aug. 30, 2018

(65) Prior Publication Data

US 2020/0054920 A1 Feb. 20, 2020

Related U.S. Application Data

(63) Continuation-in-part of application No. 15/438,233, filed on Feb. 21, 2017, now abandoned.

(51) Int. Cl.
*A63B 22/06* (2006.01)
*A63B 21/00* (2006.01)

(52) U.S. Cl.
CPC .... *A63B 22/0605* (2013.01); *A63B 21/00196* (2013.01); *A63B 22/0664* (2013.01); *A63B 2022/0611* (2013.01); *A63B 2022/0635* (2013.01)

(58) Field of Classification Search
CPC ..... A63B 21/00196; A63B 21/154; A63B 22/0605; A63B 22/0664; A63B 22/18; A63B 2022/0611; A63B 2022/0635
See application file for complete search history.

(56) References Cited

U.S. PATENT DOCUMENTS 5,833,583 A * 11/1998 Chuang ..... A63B 22/0664 482/60
7,137,929 B2 * 11/2006 Fan ..... A61H 1/001 482/57
10,384,097 B2 * 8/2019 Kaan ..... A63B 69/16
2007/0099767 A1 * 5/2007 Harashima ..... A63B 22/0605 482/57
2007/0298935 A1 * 12/2007 Badarneh ..... A63B 22/0664 482/52
2010/0234774 A1 9/2010 Cheremsky
2013/0274077 A1 10/2013 Greenberg et al.
(Continued)

OTHER PUBLICATIONS

International Search Report and Written Opinion dated Jul. 26, 2018, issued in PCT Patent Application No. PCT/ZA18/050011, 6 pages.

*Primary Examiner* — Megan Anderson
(74) *Attorney, Agent, or Firm* — Nikolas J. Uhlir; Grossman, Tucker, Perreault & PFleger PLLC

(57) ABSTRACT

An exercise machine of the type which have pedals or foot plates through which a person can, in use, transfer kinetic energy to the machine is described. In embodiments the exercise machine is configured such that the pedals or foot plats vibrate during exercise.

4 Claims, 8 Drawing Sheets

(56) References Cited

U.S. PATENT DOCUMENTS

| | | | | |
|---|---|---|---|---|
| 2014/0024502 | A1* | 1/2014 | Watterson ..... | A63B 22/0046 482/57 |
| 2015/0080190 | A1 | 3/2015 | Kaan et al. | |

* cited by examiner

STATIONARY EXERCISE MACHINE

TECHNICAL FIELD OF THE INVENTION

This invention relates to stationary exercise machines.

BACKGROUND TO THE INVENTION

The inventor is aware of the beneficial effects of vibrations during exercises. Vibrations in the range of 30 to 35 Hertz is believed to be most beneficial for recovery and injury prevention during and after exercise.

However, mechanically complex exercise machines such as bicycles, stationary bicycles, elliptical exercise machines such as, stepping machines, cross trainers and the like machines have not been able to successfully incorporate vibration technology due to the destructive effect of such vibrations on the bearings and pivot points of such machines.

It is an object of the invention to provide durable vibrating exercise machines.

General Description of the Invention

According to the invention there is provided an exercise machine of the type which have pedals or foot plates through which a person can, in use, transfer kinetic energy to the machine, which machine comprises a means for vibrating the pedals or foot plates during exercise.

The exercise machine may be a bicycle, stationary exercise bicycle, an elliptical exercise type machine, stepping machine or the like.

It is to be understood and appreciated that vibration is caused directly to the pedal or footplate, which places the vibration energy closest to the person doing exercises and minimizes the vibrations transmitted to the machine and its components.

The preferred means for vibrating the pedals or foot plates during exercise may be a rotatable pedal or footplate mounting shaft of which the rotation axis and the pedal or footplate mounting point is offset to cause a wobble, vibration or oscillation of the pedal or footplate during exercise. Alternatively, the means for vibrating the pedals or foot plates during exercise may be an electrical vibration motor mounted to the footplate or pedal.

In the case of a bicycle or stationary exercise bicycle, the bicycle comprising:

a pair of round stationary gears or stationary pulleys mounted on each side of the bicycle and with a circumference similar to the rotation circumference of rotating pedal shafts of the bicycle;

a pair of crank arms rotatably mounted and connected at one end of each crank arm through a bottom bracket of the bicycle, which bottom bracket extends through the middle of the stationary gears or stationary pulleys; and a shaft rotatably mounted through a hole defined in the free end of each crank arm with one end extending inwards towards the bicycle and provided with a coaxial gear or coaxial pulley respectively engaging the stationary gears or stationary pulley, as the case may be, with the other outwardly extending end provided with a socket for receiving a shaft of a bicycle pedal, which socket is offset from the axis of the rotatable shaft.

In the case of gears, the gears engage each other directly to transfer rotational forces and in the case of pulleys a belt transfers the rotational forces.

At least two, preferably three bearings are provided between the rotatable shaft and the hole defined in the free end of each crank arm.

It is to be appreciated that as the pedals rotate, the rotatable shaft will rotate in relation to the stationary and coaxial gear or pulley ratio, which in turn will rotate the offset socket causing the socket and therefore the pedal shaft to move in a circle about the shaft. The circular movement of the offset socket and pedal shaft is experienced by the cyclist as a small wobble or oscillation and at speed a vibration directly transmitted to a person's feet. The amplitude of the wobble or vibration is equal to the offset.

In the case of a pulley, a drive belt will connect the stationary pulley and coaxial pulley and the machine may include a belt tensioner mounted near the free end of the crank arms. The belt tensioner will rotate with the free end of the crank arm.

The gear or pulley ratio of the large stationary gear and the small coaxial gear may preferably selected such that at a typical pedaling cadence range of 70 to 100 revolutions per minute (rpm) the pedal shaft will cycle at 30 to 35 Hertz (about 2000 rpm).

The offset and therefor the amplitude of the wobble or vibration may preferably be between 1 and 5 mm.

In the case of an elliptical exercise type machine or stepping machine, a pair of stationary rack gears is mounted on each side of the machine;

a pair of footplate carrying arms attached to the machine at one end and which arms are configured to oscillate about the attached end;

a shaft rotatably mounted through a hole defined in the free end of each arm with one end extending inwards towards the machine and provided with a coaxial pinion gear respectively engaging the stationary rack gears with the other outwardly extending end provided with a socket for receiving a shaft of a footplate, which socket is offset from the axis of the rotatable shaft.

In this embodiment translation forces are transmitted to rotational forces and the rack gears may be straight or shaped in an arc to follow the movement of the reciprocating footplates.

An advantage of the invention is that the vibration source is the pedals or footplate, i.e. the working contact point between a person and the exercise machine and most of the vibrational energy is transmitted directly to the person to give maximum benefit to the person while minimizing the vibration to the bicycle thereby minimizing the destructive effect of vibrations on the bicycle or exercise machine. A further advantage of the bicycle or stationary exercise bicycle embodiment of the invention is that the vibrations are mechanically generated and no electrical motors are required and the machine does not have to be connected to a power source. In addition, the interaction of the gears provide a source of resistance to pedaling, which lowers the required resistance to be provided by the usual resistance means of stationary exercise machines.

DETAILED DESCRIPTION OF THE INVENTION

The invention is now described by way of example with reference to the accompanying drawings.

Figure 1:
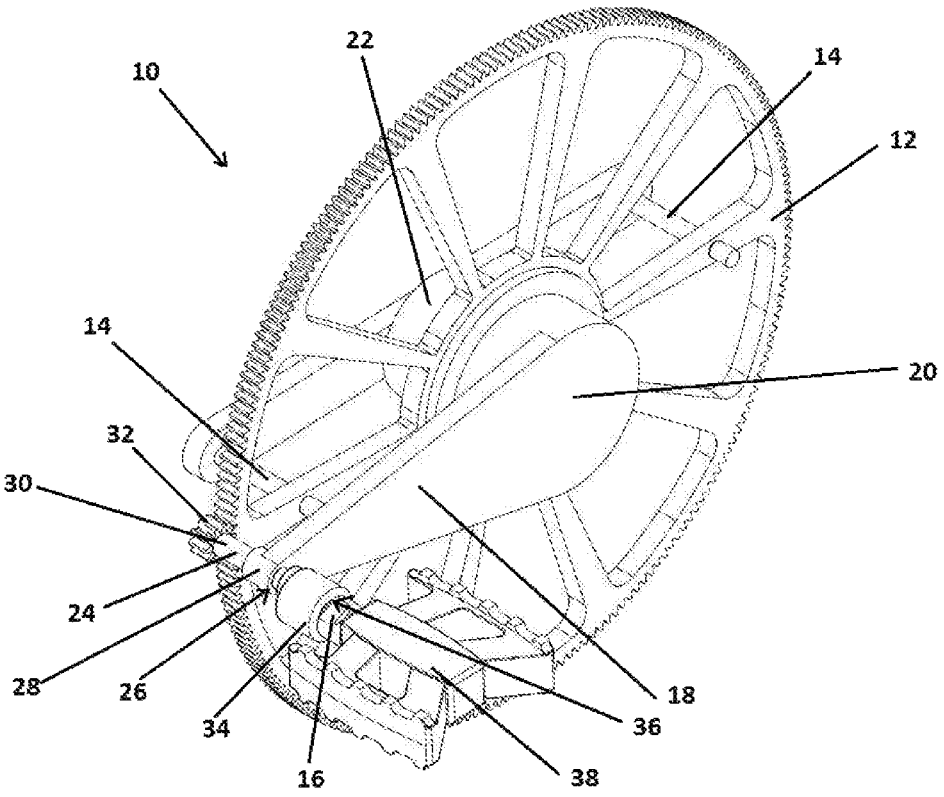
FIG. 1 shows a rear view of part of one embodiment of an exercise machine in the form of a stationary exercise bicycle, in accordance with the invention.
Figure 2:
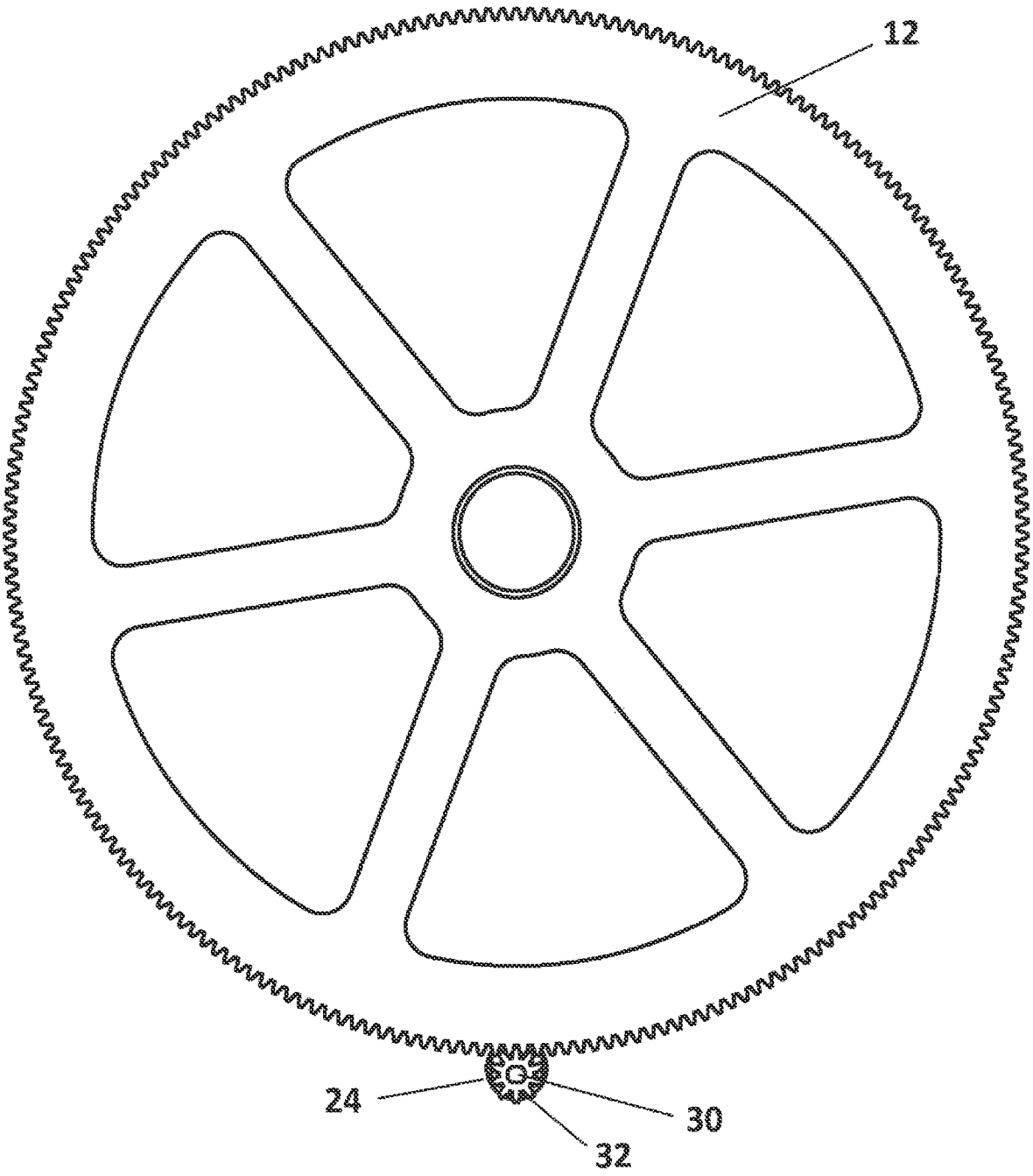
FIG. 2 shows a side view of the gears of the stationary exercise bicycle.
Figure 3:
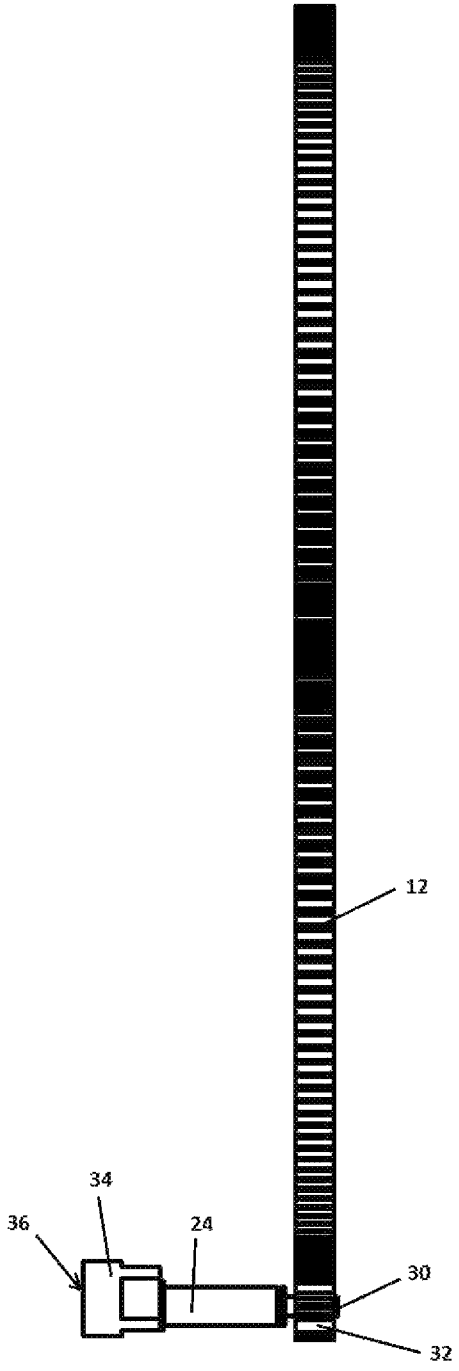
FIG. 3 shows an end view of the gears of the stationary exercise bicycle.
Figure 4:
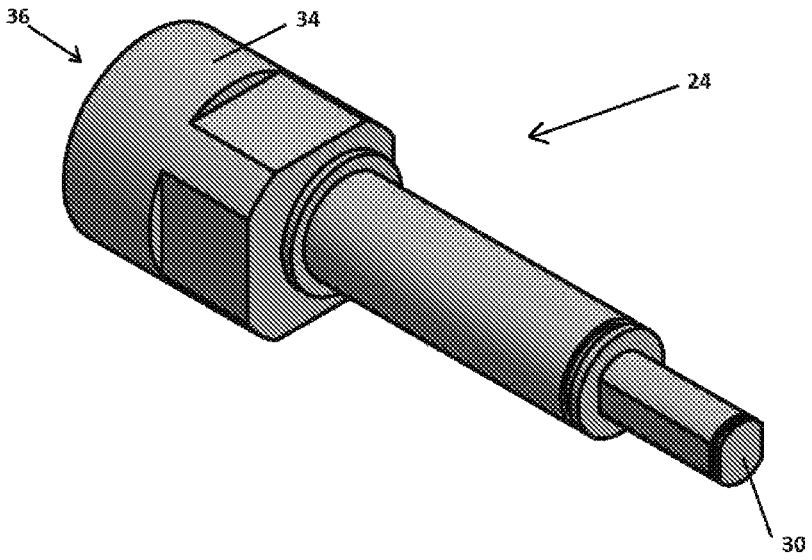
FIG. 4 shows a perspective view of a rotatable shaft of the stationary exercise bicycle.
Figure 5:
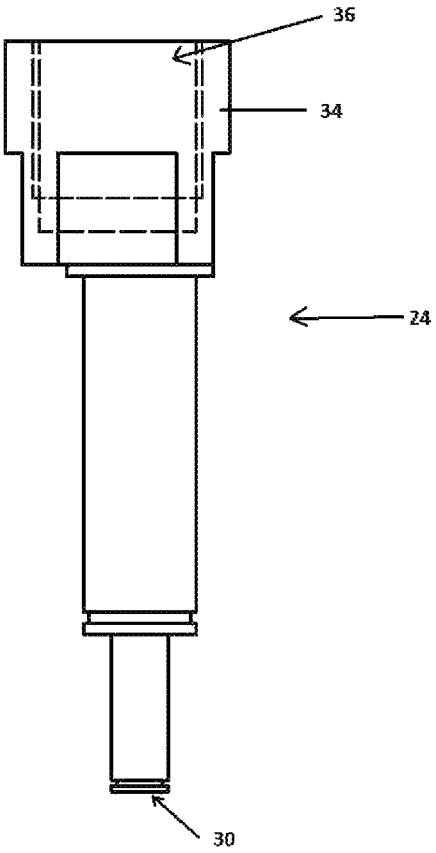
FIG. 5 shows a first side view of a rotatable shaft of the stationary exercise bicycle.
Figure 6:
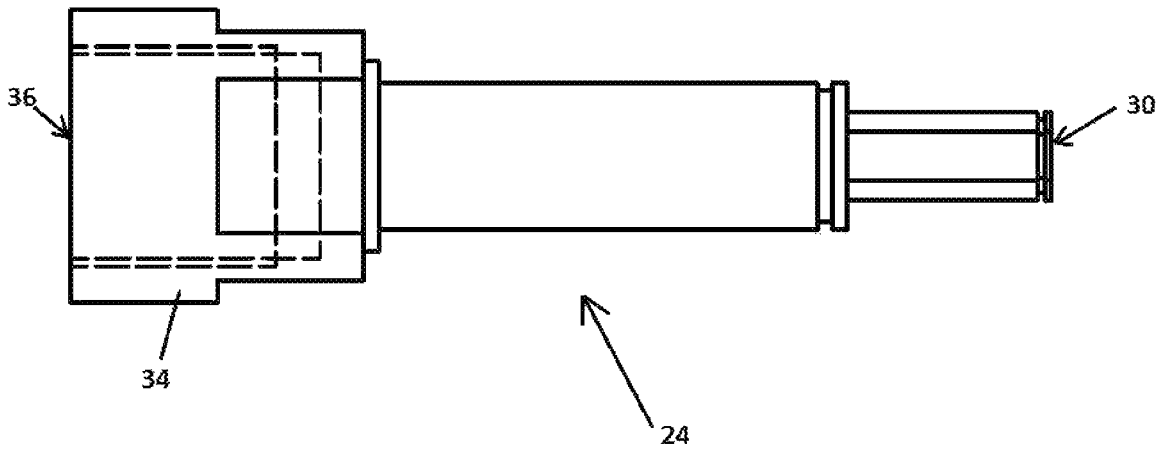
FIG. 6 shows a second side view of the rotatable shaft of the stationary exercise bicycle.
Figure 7:
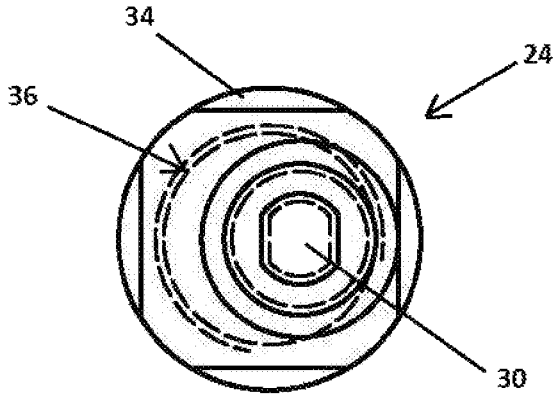
FIG. 7 shows an end view of a rotatable shaft of the stationary exercise bicycle.
Figure 8:
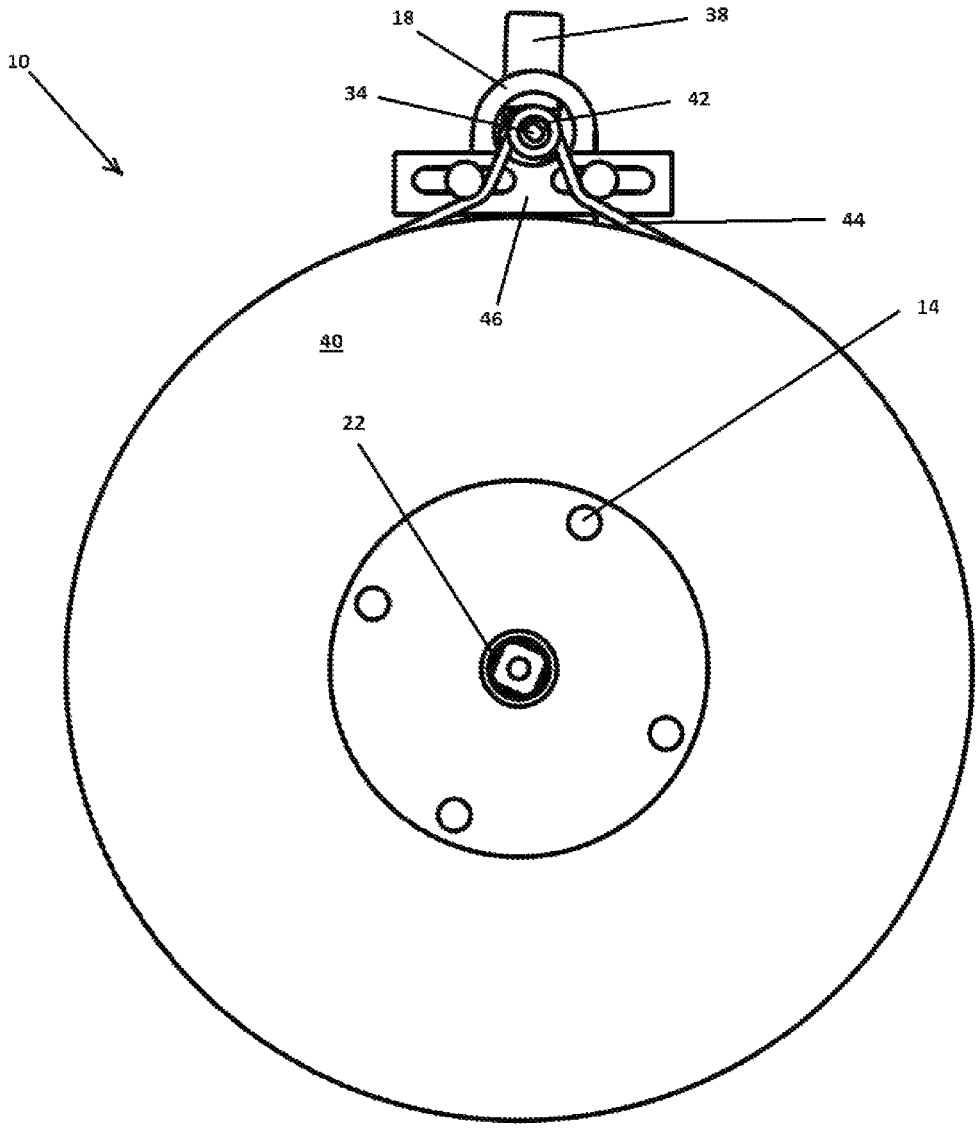
FIG. 8 shows a rear view of part of another embodiment of an exercise machine in the form of a stationary exercise bicycle, in accordance with the invention.
Figure 9:
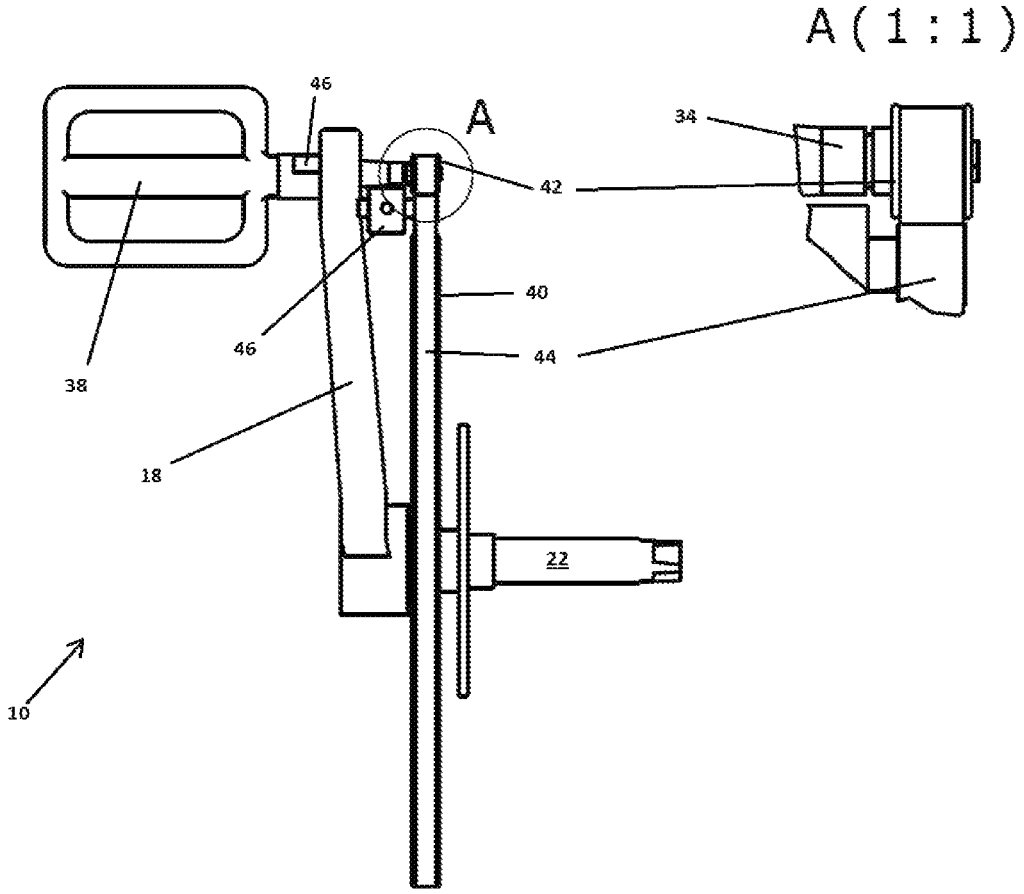
FIG. 9 shows an end view of the pulleys of the stationary exercise bicycle.
Figure 10:
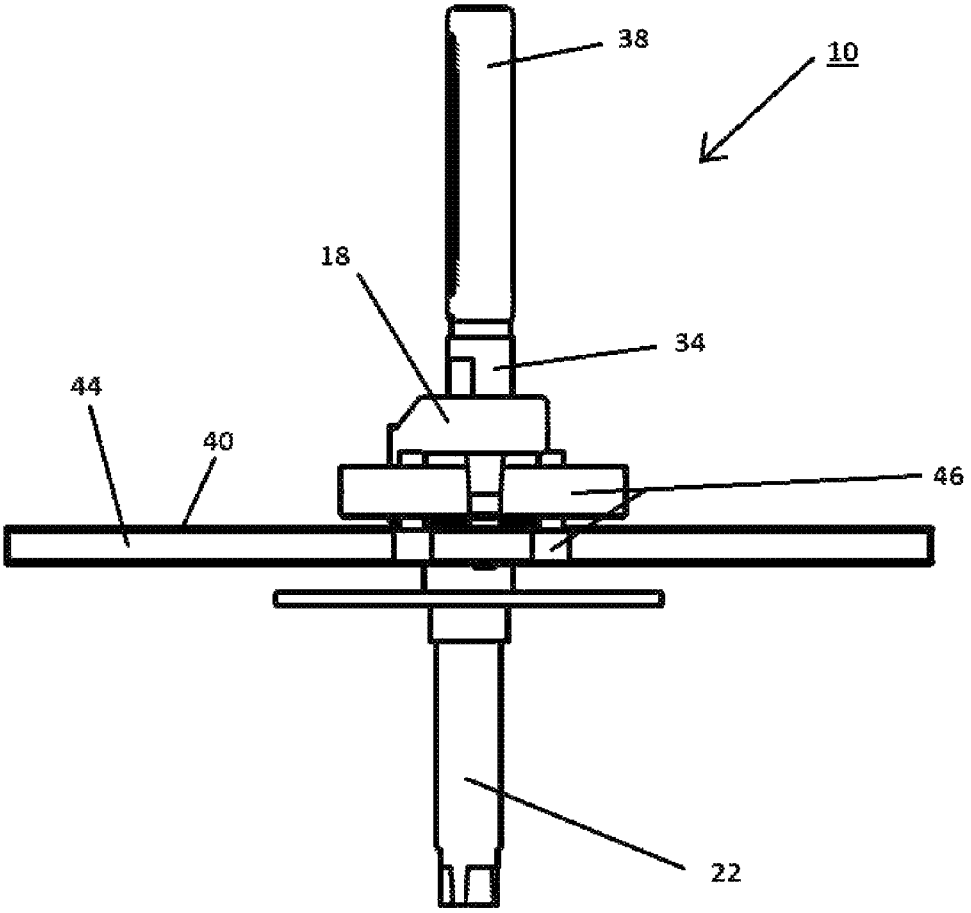
FIG. 10 shows an top view of the pulleys of the stationary exercise bicycle.
Figure 11:
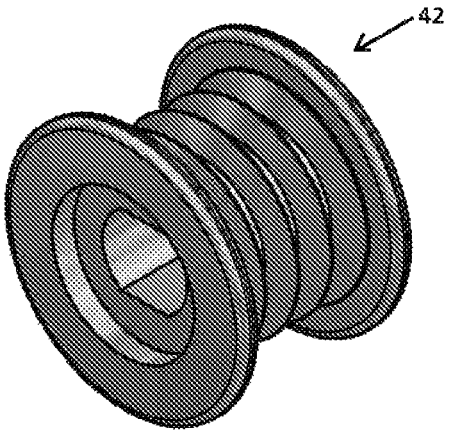
FIG. 11 shows details of the coaxial pulley.

Referring now to the drawings, the exercise machine in the form of a stationary exercise bicycle, in accordance with an example of the invention, is generally indicated by reference numeral 10.

The stationary exercise bicycle 10 comprises a means for vibrating the pedals during exercise. In one embodiment, the exercise bicycle comprises a pair of stationary gears 12 mounted on each side of the bicycle. The stationary gears are bolted by means of bolts 14 onto the frame (not shown) and have a circumference similar to the circumference of rotating pedal shafts 16 of the bicycle. A pair of crank arms 18 rotatably mounted and connected at one end 20 of each crank arm through a bottom bracket 22 of the bicycle 10. A shaft 24 is rotatably mounted through a hole 26 defined in the free end 28 of each crank arm 18 with one end 30 extending inwards towards the bicycle 10 and provided with a coaxial gear 32 respectively engaging the stationary gears 12, with the other outwardly extending end 34 provided with a socket 36 for receiving the 16 shaft of a bicycle pedal 38. The socket 36 is offset from the axis of the rotatable shaft 24. A pair of bearings (not shown) are provided between the rotatable shaft 24 and the hole 26 defined in the free end 28 of each crank arm 18.

The gear ratio of the large stationary gear 12 and the small coaxial gear 32 is selected such that at a typical pedaling cadence range of 90 revolutions per minute (rpm) the pedal shaft 16 will cycle or wobble at 33.2 Hertz. The offset and therefor the amplitude of the wobble or vibration is 5 mm.

In another embodiment of the invention, the exercise bicycle comprises a pair of stationary pulleys 40 mounted on each side of the bicycle. The stationary pulleys 40 are bolted by means of bolts 14 onto the frame (not shown) and have a circumference similar to the circumference of rotating pedal shafts 16 of the bicycle. A pair of crank arms 18 rotatably mounted and connected at one end 20 of each crank arm through a bottom bracket 22 of the bicycle 10, which bottom bracket extends through the middle of the stationary pulleys. A shaft 24 is rotatably mounted through a hole 26 defined in the free end 28 of each crank arm 18 with one end 30 extending inwards towards the bicycle 10 and provided with a coaxial pulley 42 respectively engaging the stationary pulleys 40 by means of a drive belt 44, with the other outwardly extending end 34 provided with a socket 36 for receiving the 16 shaft of a bicycle pedal 38. The socket 36 is offset from the axis of the rotatable shaft 24. A pair of bearings (not shown) are provided between the rotatable shaft 24 and the hole 26 defined in the free end 28 of each crank arm 18. The drive belt 44 connects the stationary pulleys 40 and coaxial pulleys 42 and the machine includes a belt tensioner 46 mounted near the free end of each crank arm 18. The belt tensioners 46 rotate with the free end of each crank arm 18.

The ratio of the large stationary pulley and the small coaxial pulley 42 is selected such that at a typical pedaling cadence range of 90 revolutions per minute (rpm) the pedal shaft 16 will cycle or wobble at 33.2 Hertz. The offset and therefor the amplitude of the wobble or vibration is between 5 mm.

It shall be understood that the examples are provided for illustrating the invention further and to assist a person skilled in the art with understanding the invention and are not meant to be construed as unduly limiting the reasonable scope of the invention.

What is claimed is:

1. The exercise machine, comprising:

a stationary pulley mounted on a side of the exercise machine;

a bottom bracket extending through the stationary pulley;

a crank arm comprising one end connected the bottom bracket and a free end comprising a hole;

a drive belt;

a rotatable shaft mounted through the hole in the free end of the crank arm, the rotatable shaft comprising:

one end extending inwards towards the exercise machine and comprising a coaxial pulley engaged with the stationary pulley via the drive belt; and an outwardly extending end comprising a socket; and a pedal shaft coupled to a pedal;

wherein:

the pedal shaft is received within the socket; and the socket is offset from a rotational axis of the rotatable shaft such that a rotation of the rotatable shaft about the rotational axis causes the pedal to wobble or vibrate.

2. The exercise machine as claimed in claim 1, wherein a ratio of the stationary pulley and the coaxial pulley is selected such that at a pedaling cadence in a range of 70 to 100 revolutions per minute (rpm), the pedal shaft will cycle at 30 to 35 Hertz.

3. The exercise machine as claimed in claim 2, wherein the offset and therefor the amplitude of the wobble or vibration is between 1 and 5 mm.

4. An exercise machine as claimed in claim 1, wherein the exercise machine is a stationary exercise bicycle.

* * * * *